US006295654B1

(12) United States Patent
Farrell

(10) Patent No.: US 6,295,654 B1
(45) Date of Patent: Oct. 2, 2001

(54) PROTECTIVE SPORTS GARMENT

(76) Inventor: Daniel P. Farrell, 71 Messenger St., Apt. 908, Plainville, MA (US) 02762

( * ) Notice: Subject to any disclaimer, the term of this patent is extended or adjusted under 35 U.S.C. 154(b) by 0 days.

(21) Appl. No.: 09/525,963

(22) Filed: Mar. 15, 2000

Related U.S. Application Data

(60) Provisional application No. 60/125,760, filed on Mar. 23, 1999.

(51) Int. Cl.[7] ..... A41D 13/00

(52) U.S. Cl. ..... 2/456; 2/108; 2/267

(58) Field of Search ..... 2/456–458, 69, 2/69.5, 2.5, 81, 85, 93–94, 102, 267, 16, 22, 24, 463, 465–467

(56) References Cited

U.S. PATENT DOCUMENTS

| | | | | |
|---|---|---|---|---|
| D. 320,475 | | 10/1991 | Jeter, Jr. . | |
| 3,991,420 | | 11/1976 | Savarino . | |
| 3,999,220 | | 12/1976 | Keltner . | |
| 4,195,362 | | 4/1980 | Rolando . | |
| 4,280,342 | | 7/1981 | Eng et al. . | |
| 4,325,148 | | 4/1982 | Livernois . | |
| 4,333,181 | | 6/1982 | Corriero . | |
| 4,344,189 | | 8/1982 | Futere et al. . | |
| 4,370,754 | | 2/1983 | Donzis . | |
| 4,397,043 | * | 8/1983 | Croteau | 2/456 |
| 4,422,183 | | 12/1983 | Landi et al. . | |
| 4,453,271 | | 6/1984 | Donzis . | |
| 4,467,475 | | 8/1984 | Gregory et al. . | |
| 4,580,296 | | 4/1986 | Cano . | |
| 4,590,622 | | 5/1986 | Wolfe et al. . | |
| 4,608,716 | | 9/1986 | Brumfield . | |
| 4,648,136 | | 3/1987 | Higuchi . | |
| 4,688,269 | | 8/1987 | Maeshima . | |
| 4,756,026 | | 7/1988 | Pierce, Jr. . | |
| 4,783,853 | | 11/1988 | Zuber . | |
| 4,821,339 | | 4/1989 | Fair . | |
| 4,847,913 | * | 7/1989 | Chen | 2/456 |
| 4,870,705 | | 10/1989 | Higby et al. . | |
| 4,923,728 | | 5/1990 | Snedeker . | |
| 4,993,076 | | 2/1991 | Dierickx . | |
| 4,996,720 | | 3/1991 | Fair . | |
| 5,007,108 | | 4/1991 | Laberge et al. . | |
| 5,020,156 | * | 6/1991 | Neuhalfen | 2/456 |
| 5,054,127 | | 10/1991 | Zevchak . | |
| 5,071,698 | | 12/1991 | Scheerder et al. . | |
| 5,093,931 | | 3/1992 | LaBerge et al. . | |
| 5,168,576 | | 12/1992 | Krent et al. . | |
| 5,319,806 | | 6/1994 | Hermann et al. . | |
| 5,325,537 | | 7/1994 | Marion . | |
| 5,337,418 | * | 8/1994 | Kato et al. | 2/456 |
| 5,353,437 | | 10/1994 | Field et al. . | |
| 5,405,312 | | 4/1995 | Jacobs . | |
| 5,423,087 | | 6/1995 | Krent et al. . | |
| 5,518,802 | | 5/1996 | Colvin et al. . | |
| 5,546,601 | | 8/1996 | Abeyta . | |
| 5,659,895 | | 8/1997 | Ford, Jr. . | |
| 5,689,836 | * | 11/1997 | Fee et al. | 2/465 |
| 5,697,101 | | 12/1997 | Aldridge . | |
| 5,720,045 | | 2/1998 | Aldridge . | |
| 6,038,700 | * | 3/2000 | Aldridge et al. | 2/81 |

* cited by examiner

*Primary Examiner*—John J. Calvert
*Assistant Examiner*—Tejash Patel
(74) *Attorney, Agent, or Firm*—Weingarten, Schurgin, Gagnebin & Hayes LLP

(57) ABSTRACT

A continuous protective garment provides a matrix of cells each containing a cube-like protective element. Continuous layers of fabric bonded along intersecting lines provides an individual cell for each of plural protective elements sandwiched between the fabric layers. An outer rigid protective surface of each protective element absorbs externally applied forces, while a middle cushioning layer provides dispersion and buffering of such externally applied forces. An innermost layer of a fluid-resistant material helps prevent perspiration from being absorbed, while a ventilation hole through the center of each protective element provides air circulation without compromising protective qualities. A substantially continuous array of cells containing the protective elements provides comprehensive surface coverage over the torso and arms of the wearer.

18 Claims, 5 Drawing Sheets

PROTECTIVE SPORTS GARMENT

CROSS REFERENCE TO RELATED APPLICATIONS

This application claims priority to U.S. Provisional Patent Application No. 60/125,760, filed Mar. 23, 1999, the content of which is incorporated herein by reference.

STATEMENT REGARDING FEDERALLY SPONSORED RESEARCH OR DEVELOPMENT

N/A

BACKGROUND OF THE INVENTION

Contact sports such as hockey often entail the use of a rigid scoring object, such as a puck or ball, which is maneuvered around a playing area during the course of the competition.

Typically, the object of such a competition is to project such an object into a scoring zone, or goal, thereby accruing points. Often such a rigid object is hurled or projected at such a goal during an attempt to score, and is also passed between players as part of the course of play. Such hurling is usually accomplished through an elongated member such as a hockey stick or baseball bat, thereby increasing the velocity of the scoring object.

It is not uncommon for the scoring object to strike a player during the course of play. Such a scoring object is typically small, and therefore tends to focus its velocity to an acute point of impact. Also, elongated members used for such play are prone to impact players rather than the scoring object. Further, physical contact between players is commonplace.

It is therefore typical for players to wear protective apparel to cushion such physical striking, particularly in areas having high likelihood of contact or those particularly susceptible to injury, such as the elbows, shoulders, and chest (heart) areas, respectively. Such protective apparel, however, tends to restrict freedom of movement, restricting the performance of the wearer, and also hinders ventilation, trapping heat and perspiration. Also, physical contact between players can dislodge protective elements, which are often frictionally fitted merely by resilient straps. Such dislodgement can render an area unprotected, and therefore vulnerable to striking. Finally, such apparel may not be continuous, having gaps between moving elements, for example, between which a scoring object could strike.

One particular example of prior art protective wear is illustrated in U.S. Pat. No. 5,325,537. This reference illustrates a continuous foam layer sandwiched between fabric layers. The fabric and foam are compressed in a grid pattern to form a plurality of raised areas. However, the resulting garment is fairly rigid due to the compressed foam at the intersection of the raised areas. The weight of the garment is partially attributable to the presence of compressed foam at these intersections. Compressed foam at the intersections also inhibits air flow. Ventilation holes are provided, though they are sparsely distributed and are only found in the compressed regions of the foam. The garment of this reference is also discontinuous, thus exposing the wearer to risk of injury.

It would therefore be beneficial to develop protective apparel which guards against the focused impact point of a projectile, does not restrict freedom of movement or ventilation to the protected area, can be easily worn and removed, and which cannot be dislodged through movement of the wearer or contact with other players.

BRIEF SUMMARY OF THE INVENTION

A continuous protective garment provides a matrix of cells each containing a cube-like protective element. Continuous layers of fabric bonded along intersecting lines provides an individual cell for each of plural protective elements sandwiched between the fabric layers. An outer rigid protective surface of each protective element absorbs externally applied forces, while a middle cushioning layer provides dispersion and buffering of such externally applied forces. An innermost layer of a fluid-resistant material helps prevent perspiration from being absorbed, while a ventilation hole through the center of each protective element provides air circulation without compromising protective qualities. A substantially continuous array of cells containing the protective elements provides comprehensive surface coverage around the torso and arms of the wearer.

DETAILED DESCRIPTION OF THE INVENTION

Figure 1:
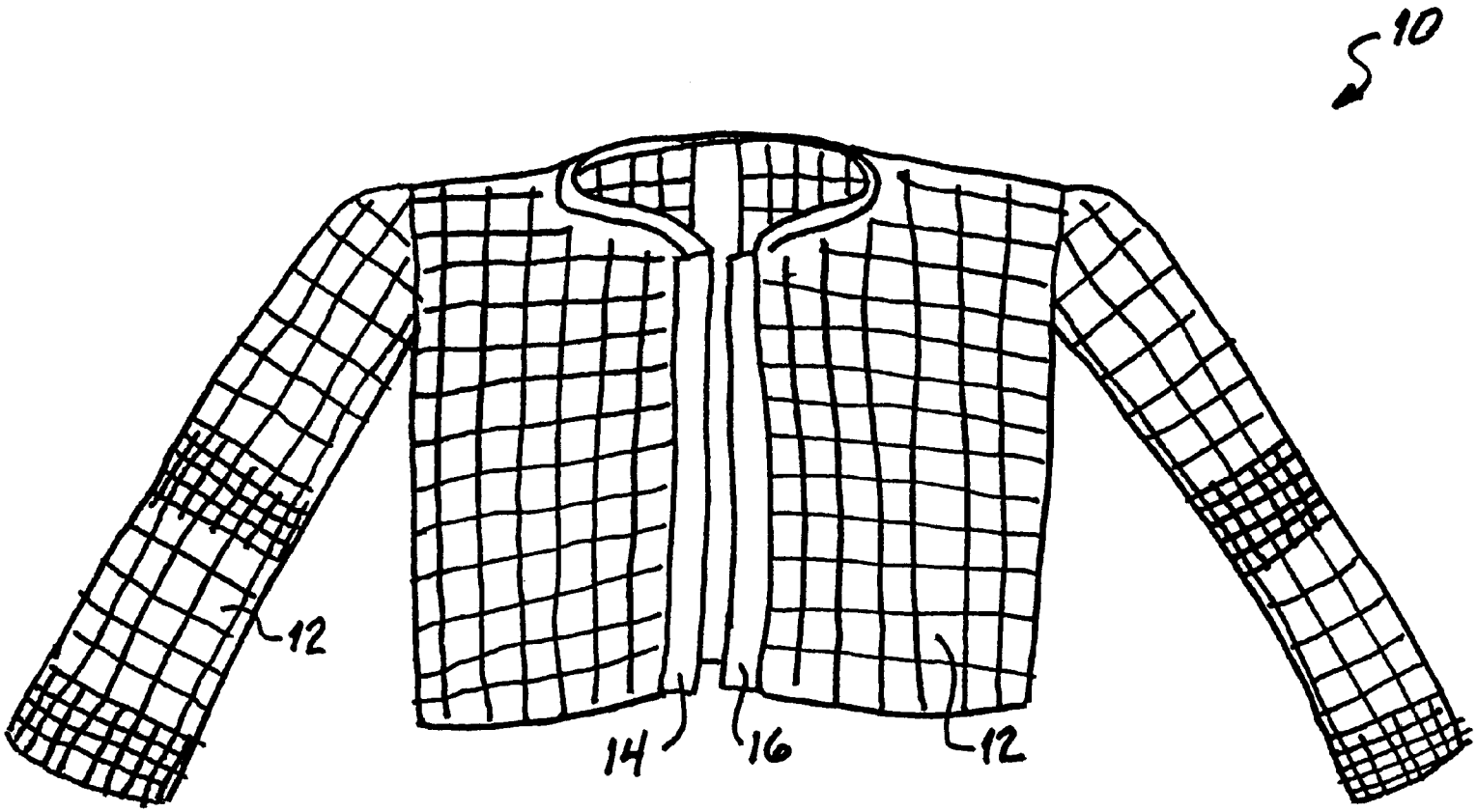
FIG. 1 illustrates one embodiment of a protective garment according to the present invention.

A protective garment having a continuous network of protective cells in a mesh arrangement protects all covered areas of the wearer. Such a continuous garment 10 is shown in FIG. 1. As the garment covers the entire upper torso, from the base of the neck down to the waistline and including the full length of the arms, no areas are left unprotected. Alternatively, other embodiments may provide for less than total coverage, in order to avoid encumbering areas of little risk.

Figure 3:
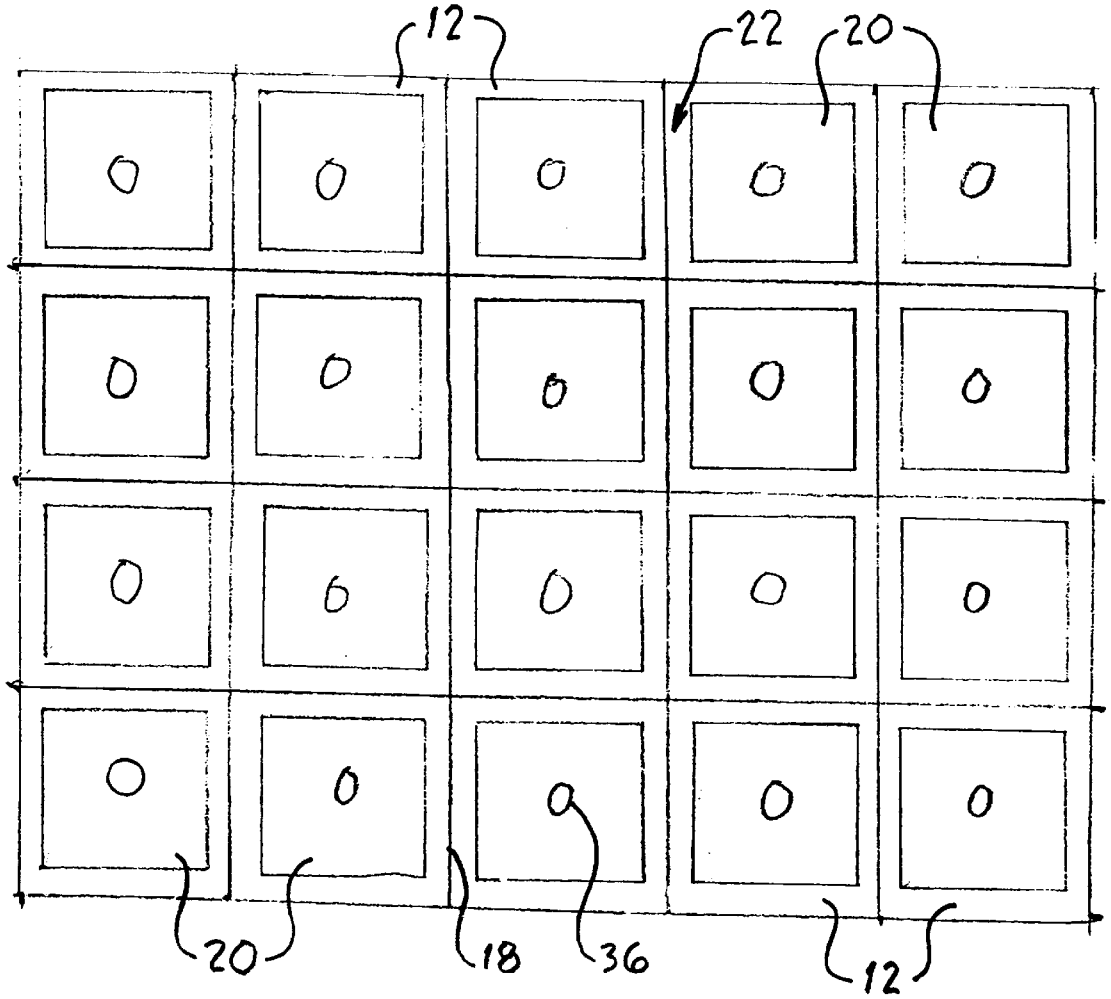
FIG. 3 shows a portion of the continuous cell mesh pattern formed by bonding the resilient fabric of the garment in FIG. 1.

The garment comprises a matrix of protective cells 12 defined between layers of resilient fabric 24 such as "LYCRA"® or "SPANDEX"®. In a preferred embodiment, a mix of 10% "LYCRA"® and 90% nylon is used. These layers 24 are bonded to each other in a matrix pattern, thereby creating a network of cells 12, each of which can contain a protective element, described below, held between the opposing fabric layers 24. A portion of such a matrix of cells is shown in FIG. 3.

The resilient nature of the fabric allows the garment to conform to and fit the contours of the wearer, if such a fit is desired. Alternatively, straps employing hook and loop fasteners such as "VELCRO"® can be used around the abdomen and arms to provide additional compression against the wearer. As illustrated in FIG. 1, one embodiment of the protective garment 10 includes a "VELCRO"® hook and loop front closure comprising a strip of looped fabric 14 and a complimentary, overlapping strip of hooks 16. Of course, the fit of the protective garment may be adjusted to accommodate the preferences of the wearer, so that more material may be provided to a garment worn by someone preferring a loose fit.

Figure 2:
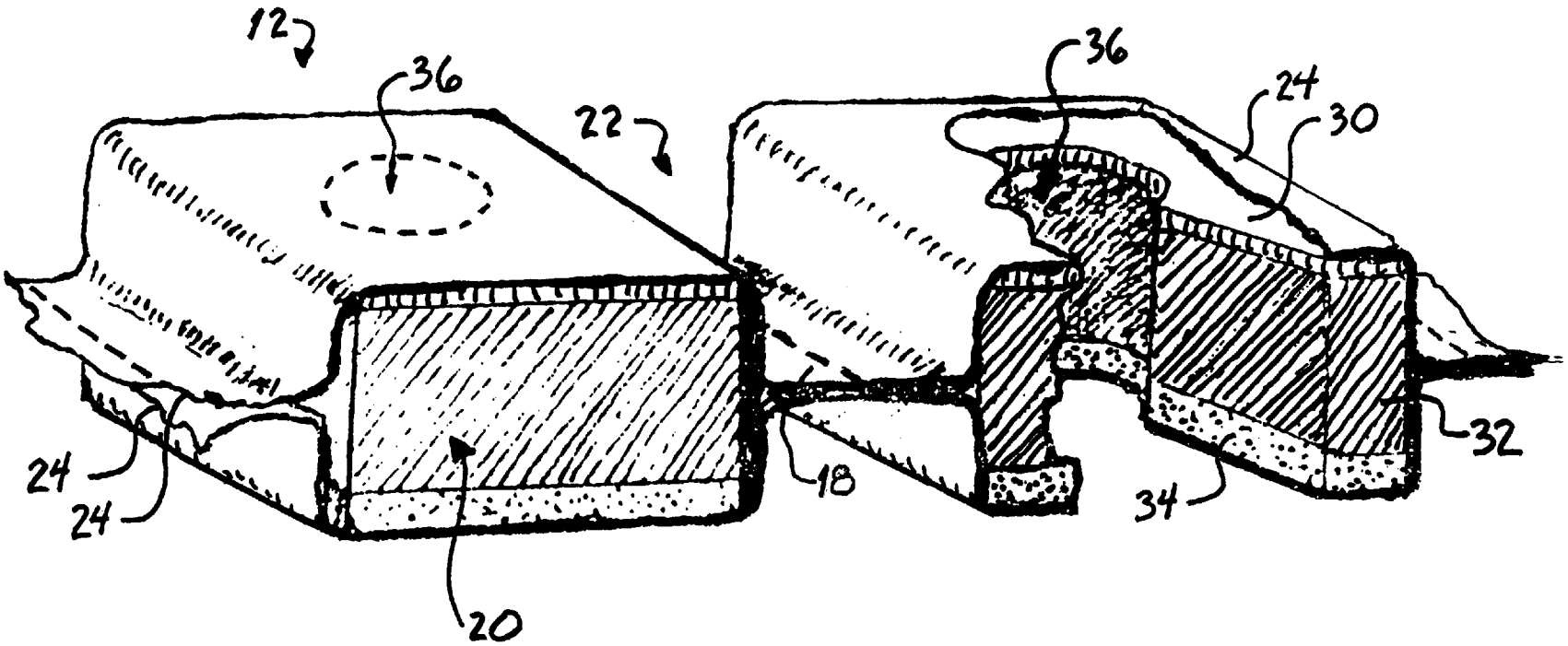
FIG. 2 is a cross-section view of individual cells containing a respective protective element such as employed in the garment in FIG. 1.

The resilient fabric layers 24 of the garment 10 may be bonded in any suitable manner, such as by heat fusing, gluing, or stitching, as long as the points of attachment form a network of independent cells to allow a protective element to be contained within each cell. As shown in FIG. 2, the fabric layers 24 are bonded through stitches 18 made with a high tensile strength plastic thread in one embodiment.

The cells 12 need not be of identical size in width or height, and it is in fact desirable to use smaller cells 12, and hence smaller protective elements, at points requiring greater mobility such as bone joints. As cells 12 are formed about protective elements 20, a series of recessed areas 22 are formed between adjacent cells 12 where the resilient fabric layers are joined. The distance between these recessed areas 22 effects the spacing between protective elements 20. The spacing is significant because too large a spacing may allow an object to impact a wearer between the protective elements 20. However, too small a spacing reduces the amount of flex permitted between cells 12, thereby reducing freedom of movement. The ideal spacing, therefore, depends on the size of the expected impact object and the freedom of movement desired by the wearer. A spacing of 0.25 inches has been found to be compatible with the needs of a high mobility game using a moderate-sized rigid scoring object such as a hockey puck.

The size of the individual protective elements 20 also affects freedom of movement. Since a thicker protective element 20 spaces the joined fabric layers 24 farther apart, angular deflection of the garment 10 must be borne by fewer joined areas, thereby forcing the garment 10 to be more rigid. For this reason, it is desirable to vary the size of the protective elements 20 in any one region of the garment 10 in relation to the degree to which that region will normally be flexed. For instance, in areas of increased mobility such as at the elbows and shoulders, it is desirable to provide smaller protective elements and cells to enhance the ability of the wearer to flex the garment 10. Dimensional variation between protective elements may be provided in terms of width and/or height. In a typical high mobility game such as hockey, a protective element 20 having a surface area of approximately one inch square has been found to be optimal for most areas of coverage, while smaller protective elements approximately 0.5 inches square are used in such increased mobility areas. The thickness of the protective elements is approximately 0.75 inch in one embodiment for all sized elements. Alternatively, the thickness of the protective elements varies with the length and width dimension of the respective element, or according to the body part over which the garment is disposed. The actual protective element 20 size may be varied to suit the particular activity, and may include a range of sizes depending upon the nature of the activity, the size of the wearer, the wearer's preferences in terms of fit, and cost.

Each of the cells 12 in the protective garment 10, in a preferred embodiment, contains a protective element 20, as shown in FIG. 2. The protective element 20 has three layers in the illustrated embodiment, though alternative embodiments may employ more or less layers. The outermost layer 30, being furthest from the wearer, is formed of a rigid polymer material such as polyethylene, typically 100 gauge high molecular weight plastic, in the preferred embodiment. This layer absorbs impact from objects and disperses the force to a middle layer 32. The middle layer 32 is comprised of cushioning resilient material such as LD 80 closed cell foam. Closed cell foam is preferred because of its resistance to fluid absorption. This resilient layer 32 disperses the force of impact across the body surface area, thereby avoiding an acute impact point.

The innermost layer 34, nearest the wearer, is of a moisture resistant material such as "COOLMAX"®. This layer provides additional resistance to moisture by dispersing moisture away from the middle foam layer and to the fabric layers 24 between cells 12 where the mesh network promotes air circulation and evaporation. The protective element layers 30, 32, 34 are all similarly sized in length and width and preferably have a generally square projection with rounded corners. The rounded corners help avoid acute edges which could jab the wearer or tend to snag the resilient fabric layers 24.

As an alternative embodiment to the single fabric layers 24 illustrated in FIG. 2 and described above, one or both of the illustrated layers is comprised of plural fabric layers. For instance, an inner fabric layer closest to the skin of a wearer may provide a soft, comfortable feel, while an adjacent layer may be more suited towards wicking moisture away from the inner layer and towards the outer surface of the garment.

Each protective element 20 in a preferred embodiment also has a bore 36 through the center to facilitate air circulation without sacrificing protective area. The diameter of this bore 36 is selected to avoid sacrificing the protective integrity of the respective protective element. The fabric layers 24 are continuous over each bore 36, though one or more of the fabric layers can be provided with an open weave suited for enhanced air flow through the bores 36. Alternatively, one or both fabric layers 24 may be provided with an orifice which is substantially aligned with the bore 36 in each or selected protective elements, thus enhancing the ability of the garment to conduct heat and water vapor away from the wearer.

In an alternative embodiment, such as a protective garment 10 for casual or youth sports participants, the protective elements are made solely of a cushioning foam 32, or a combination of closed cell foam 32 with either the rigid polymer layer 30 and/or moisture resistant layers 34. Factors affecting the choice of materials include fabrication cost, expected velocity of the scoring object and other potential impacting members, and weight.

Figure 4:
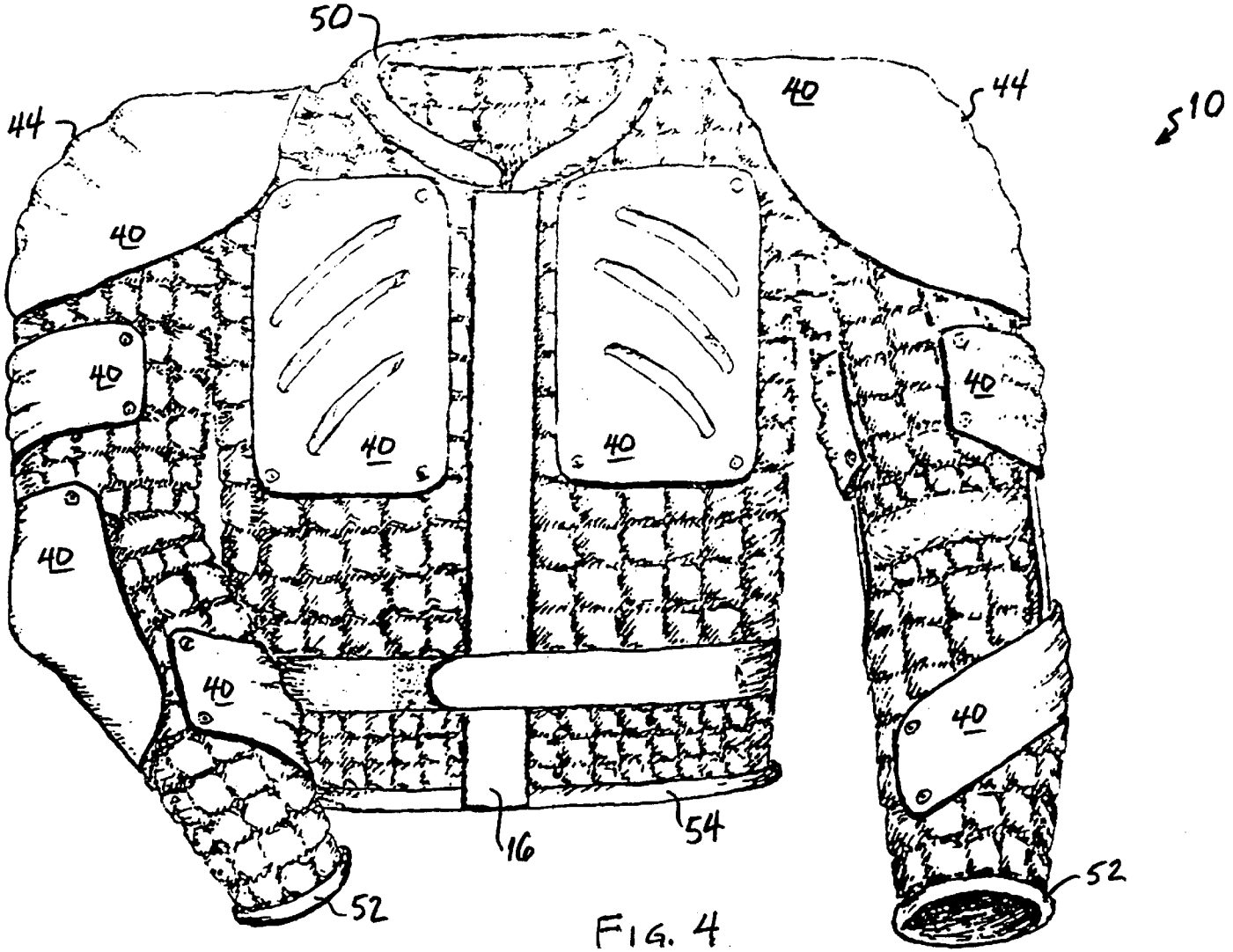
FIG. 4 is an embodiment of the protective garment of FIG. 1 with protective plates attached.

As shown in FIG. 4, portions of the garment 10 may have additional, outer rigid plates 40 of polyethylene, "KEVLAR"®, or other suitable rigid material for increased coverage in areas of potential high impact. Factors such as manufacturing cost and rigidity will affect the choice of materials for the plates. Such plates 40 may be secured in an area on top of the protective element 20 matrix, or may be secured to the resilient fabric 24 as an alternative to a matrix of protective elements 20.

Figure 5:
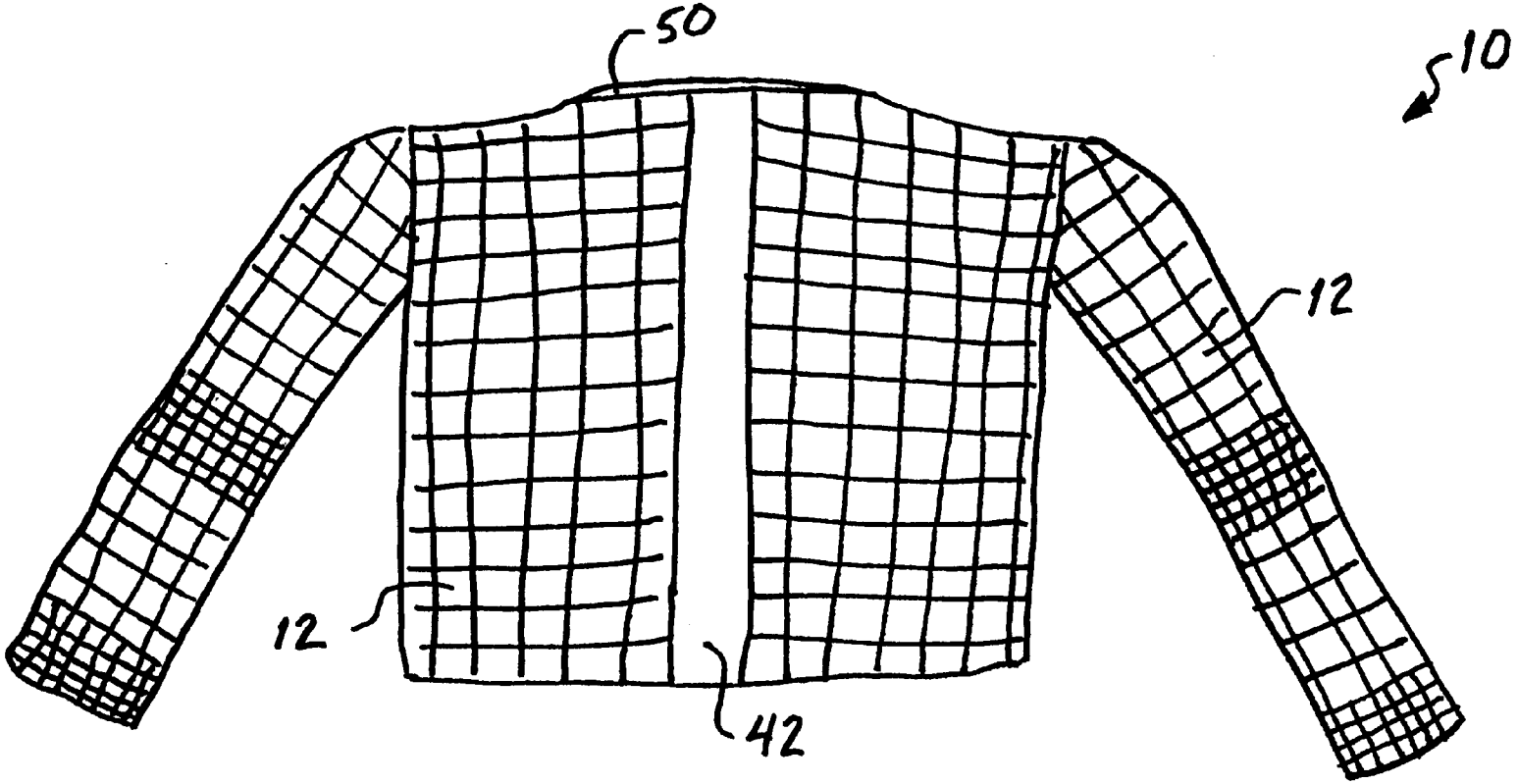
FIG. 5 is a back view of the protective garment embodiment of FIG. 1.

As shown in FIG. 4, a rigid plate 40 may be positioned over a selected area of protective elements 20, such as the chest or abdomen, to increase protection at locations of little movement. A further application of the plates 40 is shown in FIG. 5. FIG. 5 shows a "KEVLAR"® spinal protector of a resilient composition, thereby allowing the wearer to bend over while still affording the critical spinal area additional protection.

Areas requiring high mobility, such as under the arms and inside the elbows, may have a resilient gusset plate (not shown) affixed to the fabric layer in place of protective elements. Alternatively, such a plate could be affixed over a mesh of protective elements if additional protection is desired. Such a gusset plate allows shoulders and elbows to bend fully while still affording a degree of protection. Alternatively, the external gusset plates may be replaced with cells accommodating rectangular protective elements, or protective elements of any other suitable shape.

One embodiment of a shoulder plate 44, such as shown in FIG. 4, is affixed with a fabric hinge (not shown) close to the neck. The hinge allows the rigid plate 44 to protect the shoulder yet pivot upwards about the fabric hinge to accommodate upwards arm movement. Thus, such a hinge allows secure attachment of the plate 44 to the garment 10 yet allows freedom of movement by not pinning or riveting the shoulder plate at multiple points.

Alternative embodiments of protective plates may be more suited to riveting or other permanent affixation. These alternative embodiments, some of which are shown in FIG. 4, include chest plates, elbow plates, and various arm plates.

In order to enhance comfort and provide a more secure fit, the garment may be provided with an elastic collar 50, waist band 54, and cuffs 52. These elastic portions may be padded to enhance the degree of protection afforded to wearer. Moisture handling fabric such as "COOLMAX"® may be used at these locations.

Variations in the described embodiments include the adaptation of the disclosed array of protective elements to padding for other body parts including the lower body and legs. Further, the disclosed material may also find applications in providing protection for various non-human objects. For instance, suitable protective equipment may be fashioned from the disclosed material for animals or inanimate objects requiring protection from impact forces. Additionally, various fabrics may be employed for the upper and lower fabric layers, including any light-weight synthetic material having sufficient wet-strength to withstand the shear forces to which the garment will be subjected during use.

Having described preferred embodiments of the present invention it should be apparent to those of ordinary skill in the art that other embodiments and variations of the presently disclosed embodiment incorporating these concepts may be implemented without departing from the inventive concepts herein disclosed. Accordingly, the invention should not be viewed as limited to the described embodiments but rather should be limited solely by the scope and spirit of the appended claims.

What is claimed is:

1. A protective garment, comprising:

a first fabric layer;

a second fabric layer; and a plurality of substantially parallelepipedal protective elements, each having a first surface adjacent said first fabric layer and a second surface adjacent said second fabric layer, and wherein said first and second surfaces are mutually parallel and each of said protective elements is provided with a bore disposed from said first surface to said second surface, wherein said first and second fabric layers are bound together about each of said plurality of protective elements to form a matrix of said protective elements and are sandwiched about said protective elements.

2. The garment of claim 1, wherein each of said plurality of protective elements comprises a block of resilient material.

3. The garment of claim 1, wherein each of said plurality of protective elements comprises a layer of low-density, resilient material and a layer of high-density, resilient material.

4. The garment of claim 3, wherein said low-density, resilient material comprises closed cell foam.

5. The garment of claim 3, wherein said high-density, resilient material comprises polyethylene.

6. The garment of claim 3, further comprising a layer of moisture wicking material adjacent said low-density, resilient material, opposite said high-density, resilient material.

7. The garment of claim 1, wherein at least one of said first and second fabric layers is comprised of moisture wicking fabric.

8. The garment of claim 1, wherein at least one of said first and second fabric layers is comprised of an open weave fabric.

9. The garment of claim 1, wherein said garment is configured to be substantially continuous over the torso and arms of a wearer.

10. The garment of claim 1, wherein said plurality of protective elements are comprised of a first subset of protective elements having a first set of length and width dimensions and a second subset of protective elements having a second set of length and width dimensions.

11. The garment of claim 1, further comprising at least one resilient gusset plate.

12. The garment of claim 1, further comprising at least one external, resilient plate disposed on an outer surface of one of said first and second fabric layers.

13. The garment of claim 1, wherein said first and second fabric layers are bound together using heat bonding.

14. The garment of claim 1, wherein said first and second fabric layers are bound together through stitching.

15. A method of assembling material for a protective garment, comprising:

providing plural, substantially parallelepipedal resilient elements;

forming a bore in each of said resilient elements from a first surface to a parallel second surface;

providing a first fabric layer;

disposing said first surface of each of said plural resilient elements on said first fabric layer;

disposing a second fabric layer on said second surface of each of said plural resilient elements; and mutually bonding said first fabric layer with said second fabric layer about each of said plural resilient elements.

16. The method of claim 15, wherein said step of disposing said plural resilient elements on said first fabric layer further comprises:

providing plural high-density foam elements; and bonding a respective low-density foam element to each of said plural high-density foam elements to form said plural resilient elements.

17. The method of claim 16, wherein said step of disposing said plural resilient elements on said first fabric layer further comprises:

bonding a respective rigid polymer element to each of said plural high-density foam elements, opposite said respective low-density foam element, to form said plural resilient elements.

18. The method of claim 15, wherein said step of bonding said first fabric layer and said second fabric layer further comprises a step selected from the group consisting of stitching, heat fusing, and gluing said first and second fabric.

* * * * *